United States Patent [19]

Smith

[11] 4,092,251

[45] May 30, 1978

[54] DURABLE FLAME RETARDANT FINISHES FOR TEXTILE MATERIALS

[75] Inventor: Ray E. Smith, Ann Arbor, Mich.

[73] Assignee: Velsicol Chemical Corporation, Chicago, Ill.

[21] Appl. No.: 660,501

[22] Filed: Feb. 23, 1976

[51] Int. Cl.[2] ..... C09K 3/28

[52] U.S. Cl. ..... 252/8.1; 8/116 P; 427/390 D; 427/341; 427/342

[58] Field of Search ..... 252/8.1, 312; 427/390 D, 341, 342; 8/116 P

[56] References Cited

U.S. PATENT DOCUMENTS

| | | | |
|---|---|---|---|
| 3,310,419 | 3/1967 | Wagner | 427/390 D |
| 3,645,936 | 2/1972 | Gardner | 8/116 P |
| 3,660,582 | 5/1972 | Di Pietro et al. | 252/8.1 |
| 3,729,434 | 4/1963 | Todd | 252/8.1 |
| 3,784,356 | 1/1974 | Wagner | 427/390 D |
| 3,888,779 | 6/1975 | Chao | 252/8.1 |
| 3,932,502 | 1/1976 | Nachbur et al. | 252/8.1 |
| 3,936,585 | 2/1976 | Leblanc et al. | 252/8.1 |

*Primary Examiner*—Benjamin R. Padgett
*Assistant Examiner*—Deborah L. Kyle
*Attorney, Agent, or Firm*—Robert M. Phipps; Howard J. Greenwald

[57] ABSTRACT

Novel flame retardant finishes comprising a water soluble quaternary phosphonium salt, a water soluble organic nitrogen containing compound, a phosphate ester of haloalkanols, an organic solvent characterized by having a flash point of at least 80° F. and a boiling point within the range of about 300° to about 350° F., an emulsifier having a hydrophile lipophile balance value of from about 10 to about 14, and water. These flame retardant finishes are excellent for flame retarding textile materials including polyester/cotton blend fabrics.

50 Claims, No Drawings

DURABLE FLAME RETARDANT FINISHES FOR TEXTILE MATERIALS

BACKGROUND OF THE INVENTION

1. Field of the Invention

This invention pertains to finishes containing agents specifically designed to render the materials treated therewith flame retardant.

2. Description of the Prior Art

Recent years have witnessed a great interest in and a growing demand for flame retardant textiles and fabrics. Due to its substantial portion of the textile market, one such fabric which has engrossed the attention of many is polyester/cotton blends. The market dominance of these blends is due in part to consumers' demand for minimum care products of satisfactory overall performance and wear-life. However, polyester/cotton blend fabrics have persisted in evading researchers in their attempts to successfully impart durable flame retardancy to them without a loss of or significant dimunition in their physical properties. For example, although satisfactory flame retardants are available for 100% cotton fabrics and 100% polyester fabrics, satisfactory flame retardants have not hitherto been available for polyester/cotton blend fabrics. This phenomena is in part due to the fact that "(c)hemical systems which have been developed for flame retardant finishing of 100% cellulosics are not necessarily effective in imparting self-extinguishing behavior to fabrics containing cellulosic and polyester fibers." G. C. Tesoro, "Status and Prospects for Flame Resistant Polyester/Cellulose Blend Fabrics," 39, National Technical Information Service, Springfield, VA, 1973. Also, "(t)here are significant differences in the extent to which organophosphorus systems found to be effective flame retardants for cellulose maintain this effectiveness in the presence of polyester." Ibid., 39. Additionally, "(t)he synergistic contribution of nitrogen to flame retardant effectiveness of phosphorus (which has been documented for 100% cellulose substrates) has not been demonstrated as being significant in the presence of polyester." Ibid., 39.

A news release by the Textile Research Institute, Princeton, New Jersey for release not before Mar. 2, 1975, entitled "TRI Studies on Flame Retardancy of Polyester/Cotton Blends," reports that "one of the major problems with polyester/cotton blends is that the flammability behavior of these blends cannot be directly predicted from the behavior of the components. For example, the study at TRI has revealed that such blends ignite sooner, burn faster, generate heat faster, and thermally decompose faster than might be expected on the basis of the behavior of cotton and of polyester alone. The data indicate that there are important interactions between the cotton and the polyester when these two fibers are burned in combination . . . (F)or example, . . . mixtures of polyester and cotton evolve more volatile hydrocarbons, such as ethylene and acetylene, than are evolved by cotton and by polyester when these fibers are pyrolyzed alone under comparable conditions. This is one of the reasons that the blends are difficult to flame retard." This report concludes that "(a) blend becomes a new chemical species with its own unique flammability properties."

In "Progress in the Development of Flame-Resistant Polyester-Cotton Blends", Proceedings of the 1974 Symposium on Textile Flammability, 116, LeBlanc Research Corporation, 5454 Post Road, East Greenwich, Rhode Island, 1974, W. A. Reeves et al. state that "(s)atisfactory flame retardants are available for cotton fabrics and polyester fabrics but are not available for polyester/cotton blend fabrics". Although "(s)ome flame retardants for cellulosic fibers are equally effective on polyester and vice versa if one is only interested in flame resistance", "(p)roperties such as aesthetics and durability to laundering are often lacking in treated fabrics."

Vladimir Mischutin in an article entitled "A New FR System for Synthetic/Cellulosic Blends", *Textile Chemist and Colorist,* Vol. 7, No. 3, pp. 40/2 (Mar., 1975) reports that "(s)ince the passage in 1967 of the amendment to the 1953 Flammable Fabrics Act, textile researchers have sought to develop technology to produce flame retardant fabrics. This has resulted in the development of various commercial processes to render 100% cotton fabrics flame retardant. In addition, a FR process involving emulsion containing tris(dibromopropyl) phosphate was developed for 100% polyester fabrics. This technology, together with the use of inherently flame retardant fibers, was sufficient to satisfy the requirements for sleepwear in sizes 0–6X; however, the intent of the law was not limited to the sleepwear worn by children. Additional technology was needed to satisfy growing demand for flame retardant fabrics.

"Initially, it appeared a simple matter to combine the available techniques for cellulosic fabrics and for polyester goods and obtain flame retardant blends, which are by far the biggest volume used for apparel. Those that tried this approach were unpleasantly surprised. Existing technology did not answer the requirement on blends, and new techniques were needed.

"Among brominated flame retardants the material most commonly used is tris(2,3-dibromopropyl)phosphate. This material possesses good heat and hydrolytic stabilities; it is highly insoluble in water; it is colorless and nontoxic. However, tris(dibromopropyl)phosphate is a secondary plasticizer and has a tendency to impact (sic) a tacky hand to the substrates to which it is applied. In addition, due to its lack of reactive groups, it is difficult to attach permanently to both synthetic and cellulosic fibers. In view of this, all efforts to obtain a flame retardant system for polyester/cellulosic fabric which would comply with DOC FF 3–71 were completely unsuccessful."

Similarly, Dr. W. F. Battinger states in "The Application of a Phosphonium Salt Flame Retardant to Polyester-Cotton Blend Fabrics," Book of Papers, 1974 National Technical Conference, (Oct. 9 to the 11, 1974, New Orleans, Louisiana), 467, American Association of Textile Chemists and Colorists, P.O. Box 12215, Research Triangle Park, N.C. 27709, 1974, that "the treatment of polyester/cotton blends presents a difficult problem in flammability protection because of the vast differences in physical properties and burning characteristics between two fibers". In this paper, Dr. Battinger reports the results of his research with combination applications of phosphonium salts, urea and tris(2,3-dibromopropyl)phosphate in the following words:

"The lowered response of LOI to added phosphorus for a blend fabric compared to 100% cotton is indicative of major differences in flammability protective mechanisms for the two fibers. Since the phosphonium salt studied here is only marginally capable of protecting the blend utilizing phosphorus and nitrogen alone, consideration of phosphorus and bromine in combination is a viable alternative. Tris-2,3-dibromopropyl phosphate was chosen as a bromine source because of its ready availability and known activity in improving 100% polyester fabric flammability characteristics. Since the LOI/%P responses for the 50/50 and 65/35 polyester/cotton blend were similar (with respect to the same add-on levels of tetrakis(hydroxymethyl)phosphonium oxalate), the 65/35 blend is used to illustrate the combination effect . . . The dibromopropyl phosphate in perchloroethylene was padded onto the fabric, followed by drying and curing 1.5 minutes at 400° F. to simulate Thermosoling. The process wash consisted of one Kenmore wash with detergent . . . (F)ixation as judged by durability of this wash was quite good. Maximum OI values of 0.24 were obtained at about 10% Br applied. From related studies on 100% cotton for this material showing lesser durability, it can be inferred that most of the bromine containing material is associated with the polyester component of the blend. (Note: This is the converse of what applied for the phosphonium salt previously.)

"The identical fabrics used to generate these curves were then subjected to an aqueous application of tetrakis-hydroxymethyl phosphonium oxalate in the same fashion as the blends were treated previously. Applications were set to provide 2% phosphorus. This value was chosen to theoretically yield an increase of 0.05 OI unit. The consequences of the topical application . . . compared to theoretical calculations show excellent agreement indicating the additivity properties of LOI data. Somewhat surprisingly, however, while LOI values of 0.29 were attained, no samples passes the DOC vertical test.

"The anomaly of materials with LOI's of 25 passing the vertical test when phosphonium compounds alone were employed, and LOI's of 29 failing when a supplemental bromine compound is used is reconcilable in part by consideration of the action of the materials as flame retardants and the geometry of the test employed. The phosphonium compound is a "condensed phase" acting flame retardant; no evidence is available indicating its action in vapor phase chemistry, nor is it a melt-decomposition temperature reducer for polyester. Dibromopropyl phosphate, on the other hand, is known to significantly lower the melt decomposition temperature of polyester fiber. For 100% polyester fabrics, flame retardancy is enhanced by this shrinking and dripping away. In a blend with cellulose, however, this cannot occur because of the support provided by the cotton, thus the geometry of burning comes into play. In the LOI test the sample is burned vertically downward; as polyester melts, it flows from the flame front, thus depleting fuel supply. In the DOC test burning is vertically upward and the reverse effect, fuel enrichment, occurs. The net results of these effects logically seems exactly what was observed in these experiments - high LOI's but failures in DOC testing."

Concern has begun to mount as to whether polyester/cotton blend fabrics will lose their share of the textile market because of present, pending, and contemplated federal and state legislation mandating nonflammability standards for, inter alia, fabrics and textiles. A clear example of this concern can be seen in the following excerpt wherein the authors argue for the lowering of the flammability standard for polyester/-cotton blend fabrics:

"The types of fabrics used in largest volume for apparel are polyester/cotton blends. At present there is no fully commercial method of producing polyester/cotton fabric to meet FF 3–71, primarily because of problems with the hand of the treated fabrics. Obviously, if there is any extension of standards requiring selfextinguishing properties beyond the present small end-uses (children's sleepwear), the peculiarities of this blend will have to be considered.

"The importance of a standard that is no more restrictive then is necessary to get the maximum reasonable safety under realistic use situations is particularly important for polyester/cotton blend fabrics. These fabrics comprise the major portion of apparel fabrics. They also are the types of fabrics which are the most difficult to flame retard to meet FF 3–71 and retain acceptable esthetics.

"We have been able to produce cellulosic fabrics, polyester fabrics acetate fabrics, modacrylics, blends of thermoplastic fibers, etc. to meet FF 3–71. Flame retardant polyester/cotton durable press fabrics meeting FF 3–71 have not been produced by a commercially viable process.

"The key technical problem is 'hand' of the treated fabrics. The hand of treated fabrics is objectionally stiff because of the necessity of using inordinately high add-ons of chemicals to pass FF 3–71. The modified test methods we have discussed would allow for much lower add-ons of chemicals to be used which would give a more acceptable hand to the treated fabrics. This would also lower the chemical cost of the finish.

"Many apparel items - such as jackets, girls' dresses, hats, bathrobes, topcoats, etc. - may not be laundered 50 times during their life. Standards for apparel by end-use which require less extensive laundering would also allow for lower chemical add-ons to be used.

"A reasonable test method for polyester/cotton apparel fabrics should be developed as soon as possible so that FF 3–71 will not be adopted when new, more restrictive apparel standards may be required in the future." R. B. LeBlanc and D. A. LeBlanc, "Future Flammability Standards for Apparel: Can They be Reasonable and Practical, Too?," Textile Chemist and Colorist, Vol. 7, No. 5, 56/17 (April, 1975).

It has been discovered that novel flame retardant finishes are capable of rendering textile materials, including polyester/cotton blend fabrics, treated therewith flame retardant, i.e., capable of passing the U.S. Department of Commerce FF 3–71 flammability test. The flame retardant finishes of this invention impart durable flame retardancy as well as ease of care properties to fabrics and textiles treated therewith without significantly detrimentally affecting the hand of the treated fabrics and textiles.

SUMMARY OF THE INVENTION

A flame retardant finish comprising from about 16.0 percent to about 30.0 percent of a fire retardant compound of the formula

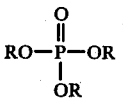

wherein each R is independently selected from halogenated aliphatic groups containing from 2 to about 6 carbon atoms and from 1 to about 3 halogen substituents per group; from about 27.0 percent to about 41.0 percent of a water soluble quaternary phosphonium salt selected from the group comprising tetrakis(hydroxymethyl)phosphonium salts and tetrakis(methyl hydroxymethyl)phosphonium salts; from about 3.2 percent to about 4.8 percent of a substantially water immiscible organis solvent characterized by having a flash point of at least 80° F. and a boiling point within the range of about 300° to about 350° F.; from about 3.2 percent to about 4.8 percent of an emulsifying agent having hydrophile lipophile balance value of from about 10 to about 14; from about 10.0 percent to about 15.0 percent of a water soluble organic nitrogen containing selected from the group consisting of

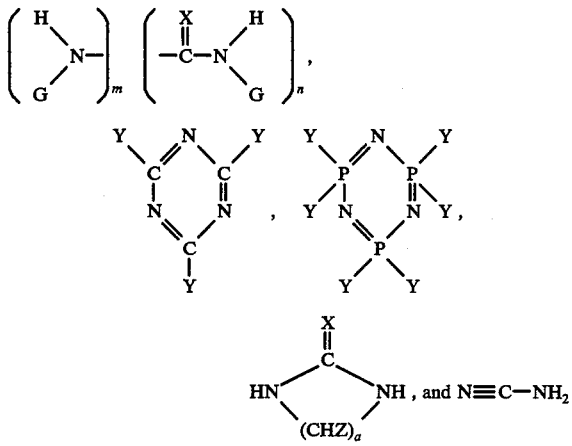

wherein each G is independently selected from the group comprising hydrogen, hydroxymethyl, alkyl containing 1 to 6 carbon atoms, amino, and cyano; X is selected from the group comprising oxygen, sulfur, =NH and =NC ≡N; m is an integer from 0 to 1; $n$ is an integer from 1 to 2 with the provision that $m + n$ equals 2; $a$ is an integer from 2 to 3; each Y independently is —NHG wherein G is defined above; and Z is selected from the group comprising hydrogen and hydroxyl; and from about 20.0 percent to about 31.0 percent of water.

The flame retardant finish of this invention imparts durable flame retardancy as well as ease of care properties to textiles and fabrics treated therewith.

DESCRIPTION OF THE PREFERRED EMBODIMENT

The flame retardant finish of this invention is composed of several constituent parts. One of the constituent parts is a flame retardant compound which comprises from about 16.0 percent to about 30.0 percent; preferably from about 18.0 percent to about 22.0 percent, and more preferably about 20.0 percent of the flame retardant finish. The flame retardant compound is of the formula

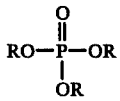

wherein each R is independently selected from halogenated aliphatic groups containing from 2 to about 6 carbon atoms and from 1 to about 3 halogen substituents per group. The flame retardant compound is preferably selected from the group comprising $(XH_2C—XHC—H_2C—O)_3—P=O$ and $(XH_2C—HC(CH_2X)—O)_3—P=O$ wherein X is chlorine or bromine. More preferably, the flame retardant compound is $(XH_2C—XHC—H_2C—O)_3—P=O$ wherein X is chlorine or bromine. Tris(2,3-dibromopropyl)phosphate is the preferred tris(2,3-dihalopropyl)phosphate flame retardant compound.

A second constituent part of the flame retardant finish of this invention is an organic solvent which comprises from about 3.2 percent to about 4.8 percent, preferably from about 3.6 percent to about 4.4 percent, and more preferably about 4.0 percent of the flame retardant finish. The organic solvent is substantially water immiscible and is further characterized by having a flashpoint of at least 80° F. and a boiling point within the range of about 300° to about 350° F. An additional description of the above organic solvent appears in J. Todd, U.S. Pat. No. 3,729,434 (1973), said patent being incorporated herein in toto by reference.

A third constituent part of the flame retardant finish of this invention is an emulsifying agent which comprises from about 3.2 percent to about 4.8 percent, preferably from about 3.6 percent to about 4.4 percent, and more preferably about 4.0 percent of the flame retardant finish. The emulsifying agent possesses a hydrophile liphophile balance value of from about 10 to about 14. Examples of emulsifying agents having a hydrophile liphophile balance value of from about 10 to about 14 may be found in McCutcheon's Detergents & Emulsifiers, North American Edition, pp. 219-223, McCutcheon's Division, Allured Publishing Corp., Ridgewood, N.J., 1974, said pages being incorporated herein in toto by reference. Preferably, the emulsifying agent is selected from the group comprising (1) a nonionic/anionic blend of an isopropyl amine salt of dodecylbenzene sulfonic acid and an ethoxylated alcohol containing from 10 to 18 carbon atoms and (2) an oil soluble metal sulfonate and a polyoxyethylene ether blended in proportions such that the emulsifying agent possesses a hydrophile liphophile balance of from about 10 to about 14. The latter emulsifying agent is the one most preferred and an additional description of it appears in J. Todd, U.S. Pat. No. 3,729,434 (1973), said patent having been incorporated herein in toto by reference. It should also be specifically noted that it is possible to prepare emulsifying agents that come within the scope of this invention by blending an emulsifier having a hydrophile liphophile value of less than 10 with an emulsifier having a hydrophile liphophile value of greater than 14 to prepare a blended emulsifying agent, commmonly referred to in the art as a "matched pair", having a hydrophile liphophile value of from about 10 to about 14.

A fourth constituent part of the flamme retardant finish of this invention is a water soluble quaternary phosphonium salt which comprises from about 27.0 percent to about 41.0 percent, preferably from about 30.4 percent to about 37.2 percent, and more preferably about 33.8 percent of the flame retardant finish. The water soluble quaternary phosphonium salt is selected from the group comprising tetrakis(hydroxymethyl)phosphonium and tetrakis(methylhydroxymethyl)phosphonium salts wherein the anion is derived from organic or inorganic, mono or polybasic acids and blends thereof. Examples of inorganic monobasic acids include hydrochloric, hydrofluoric, hydrobromic, hydroiodic, and nitric acids. Examples of inorganic polybasic acids include sulfuric and phosphoric acids. Examples of organic monobasic acids include acetic,, propionic, benzoic, methylsulfonic, p-toluenesulfonic, benzenesulfonic, stearic formic, lactic, and picric acids. Examples of organic polybasic acids include oxalic, malic, maleic, ethylene diamine hydroxymethyl triacetic, ethylene diamine tetraacetic and tartaric acid. The water soluble quaternary phosphonium salt is preferably a tetrakis(hydroxymethyl)phosphonium salt selected from the group comprising tetrakis(hydroxymethyl)phosphonium oxalate, tetrakis(hydroxymethyl)phosphonium phosphate acetate, tetrakis(hydroxymethyl)phosphonium chloride, and bis(tetrakis(hydroxymethyl)phosphonium)sulfate. The more preferred tetrakis(hydroxymethyl)phosphonium salts for use in this invention's flame retardant finish are tetrakis(hydroxymethyl)phosphonium oxalate and tetrakis(hydroxymethyl)phosphonium phosphate acetate, the latter being most preferred.

A fifth constituent part of the flame retardant finish of this invention is a water soluble organic nitrogen containing compound which comprises from about 10.0 percent to about 15.0 percent, preferably from about 11.2 percent to about 13.6 percent, and more preferably about 12.4 percent of the flame retardant finish. Said nitrogen containing compound is selected from the group consisting of

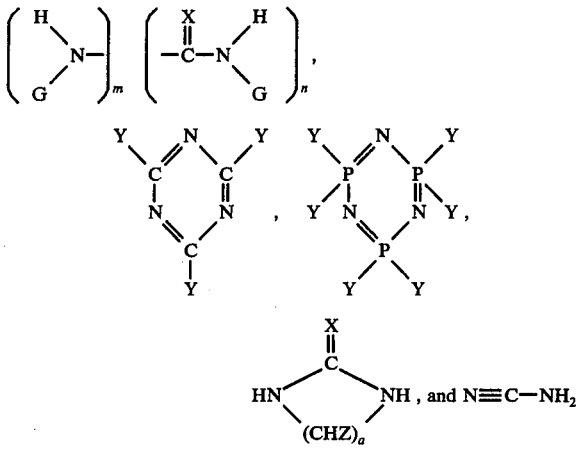

wherein each G is independently selected from the group comprising hydrogen, hydroxymethyl, alkyl containing 1 to 6 carbon atoms, amino, and cyano; X is selected from the group comprising oxygen, sulfur, =NH, and =NC≡N; m is an integer from 0 to 1; $n$ is an integer from 1 to 2 with the provision that $m + n$ equals 2; $a$ is an integer from 2 to 3; each Y independently is —NHG wherein G is defined above; and Z is selected from the group comprising hydrogen and hydroxyl; preferably G is selected from the group comprising hydrogen, hydroxymethyl, amino, and cyano; and all G substituents are preferably the same. Exemplary compounds within the broad class of water soluble organic nitrogen containing compounds that may be used in this invention's flame retardant finish include urea, thiourea, guanidine, dicyandiamide, melamine, trimethylol melamine, aminocyclophosphazene, N-methylocyclophosphazene, ethylene urea, propylene urea, cyanamide and oxamide. Preferred water soluble organic nitrogen containing compounds include urea, thiourea, guanidine, dicyandiamide, melamine, ethylene urea, and propylene urea, with urea being the most preferred compound.

A sixth constituent part of the flame retardant finish of this invention is water which comprises from about 20.0 percent to about 31.0 percent, preferably from about 23.2 percent to about 28.4 percent, and more preferably about 25.8 percent of the flame retardant finish.

The flame retardant finish of this invention may optionally have incorporated therein a wetting agent. If the wetting agent is a constituent part of the flame retardant finish, the wetting agent would comprise from about 0.1 percent to about 1.0 percent, preferably from about 0.2 percent to about 0.8 percent, and more preferably about 0.6 percent of the flame retardant finish. The wetting agents which may be employed in this invention may be selected from the group comprising anionic, non-ionionic, and nonionic-anionic blend wetting agents. Exemplary wetting agents include an anionic phosphate surfactant in free acid form, a nonionic nonylphenyl polyethylene glycol ether, a nonionic octylphenoxy polyethoxy ethanol, a nonionic trimethyl nonyl polyethylene glycol ether, and a nonionic polyethylene glycol ether of linear alcohol. These and other wetting agents are well known to people skilled in the fabric treating art.

A preferred method of making the flame retardant finish of this invention involves adding the desired amounts of the various constituents in the following sequence: (1) dissolve the water soluble organic nitrogen containing compound in water, (2) add the wetting agent, if used, to (1) while keeping the temperature of the water soluble organic nitrogen containing compound water-wetting agent solution below 40° C., (3) add an aqueous solution of the desired above described water soluble quaternary phosphonium salt to (2) and finally add to (3) an emulsion concentrate comprising the above described flame retardant compound, the above described solvent, and the above described emulsifying agent.

Another preferred method of making the flame retardant of this invention involves adding the desired amounts of the various constituents in the following sequence: (1) add the wetting agent, if used, to an aqueous solution of the desired above described water soluble quaternary phosphonium salt, (2) add to (1) an emulsion concentrate comprising the above described flame retardant compound, the above described solvent, and the above described emulsifying agent, (3) add water to (2), and finally add the water soluble organic nitrogen containing compound to the intermediate flame retardant composition of (3).

The above intermediate flame retardant composition may contain from about 19.6 percent to about 26.6 percent, preferably from about 20.8 percent to about 25.4 percent, and more preferably about 23.1 percent of the above described flame retardant compound; from about 3.9 percent to about 5.1 percent, preferably from about 4.0 percent to about 5.0 percent, and more preferably about 4.5 percent, of the above described solvent; from about 3.9 percent to about 5.1 percent, preferably from about 4.0 percent to about 5.0 percent, and more preferably about 4.5 percent, of the above described emulsifying agent; from about 32.7 percent to about 44.3 percent, preferably from about 34.6 percent to about 42.4 percent, and more preferably about 38.5 percent, of the above described water soluble quaternary phosphonium salt; and from about 25.0 percent to about 33.8 percent, preferably from about 26.5 percent to about 32.3 percent, and more preferably about 29.4 percent water. It should be clearly understood that certain intermediate flame retardant compositions can contain as little water as that water present solely in the above described aqueous solution of the desired water soluble quaternary phosphonium salt. Also, the intermediate flame retardant composition may optionally contain from about 0.2 percent to about 0.8 percent of the above described wetting agent.

The intermediate flame retardant compositions of the invention, i.e., compositions containing the above described water soluble quaternary phosphonium salt, the above described flame retardant, the above described solvent, the above described emulsifying agent, and the above described wetting agent, if used, may be used in the ammonia cure process wherein a fabric substrate is treated with said intermediate flame retardant composition and then introduced into an ammonia environment. For a more detailed description of the ammonia cure process see F. H. Day, "The FireStop$^{TM}$ Flame Retardant Process for Cotton Textiles," Proceedings of the 1973 Symposium on Textile Flammability, 41, LeBlanc Research Corporation, 5454 Post Road, East Greenwich, Rhode Island, 1973, and G. Hooper, "Phosphine-Based Fire Retardants for Cellulosic Textiles," Proceedings of the 1973 Symposium on Textile Flammability, 50, LeBlanc Research Corporation, 5454 Post Road, East Greenwich, Rhode Island, 1973, both articles incorporated herein in toto by reference. It should be specifically noted that the ammonia acts in place of the water soluble organic nitrogen containing compound to react with the water soluble quaternary phosphonium salt of the intermediate flame retardant finish to form a highly cross-linked water insoluble phosphorus and nitrogen polymer.

The flame retardant emulsion concentrate, supra, may contain from about 66.0 percent to about 78.5 percent, preferably from 68.5 percent to about 75.7 percent, and more preferably about 71.4 percent of the above described flame retardant; from about 13.2 percent to about 15.7 percent, preferably from about 13.7 percent to about 15.2 percent, and more preferably about 14.3 percent, of the above described solvent; and from about 13.2 percent to about 15.7 percent, preferably about 13.7 percent to about 15.2 percent and more preferably about 14.3 percent of the above described emulsifying agent. Example 1, 2, and 3 and Table I of Example 4, all infra, clearly indicate the criticality of the ranges specified above for the emulsion concentrate within the scope of this invention.

Also within the scope of this invention is an emulsion which may comprise from about 45.0 percent to about 55.0 percent, preferably from about 47.5 percent to about 52.5 percent, and more preferably about 50.0 percent, of the above described flame retardant compound; from about 9.0 percent to about 11.0 percent, preferably from about 9.5 percent to about 10.5 percent, and more preferably about 10.0 percent, of the above described solvent; from about 9.0 percent to about 11.0 percent, preferably from about 9.5 percent to about 10.5 percent, and more preferably about 10.0 percent, of the above described emulsifying agent; and from about 27.0 percent to about 33.0 percent, preferably from about 28.5 percent to about 31.5 percent, and more preferably about 30.0 percent of water. The above described emulsion within the scope of this invention possesses the unexpected phenomenon of being able to contain more solids than prior art emulsions while possessing the same viscosity as said prior art emulsions. See Example 11, infra. This unexpected phenomenon possessed by the emulsions within the scope of this invention enables said emulsions to deliver more solids at the same viscosity as exhibited by prior art emulsions and therefore enables the emulsions within the scope of this invention to possess better flame retarding efficacy than possessed by prior art emulsions.

It should also be noted that the above discussion concerning the preferred flame retardant compounds, the preferred water soluble quaternary phosphonium salt, and the preferred water soluble organic nitrogen containing compounds of the flame retardant finish is equally applicable to the the emulsion concentrate, emulsion, and intermediate flame retardant finish, where appropriate.

The flame retardant finish may be applied to textile fabrics by a pad, dry, cure and oxidative afterwash procedure. The temperature of the flame retardant finish during application should be maintained at a temperature of from about 0° to about 27° C. and preferably from about 15° to about 21° C. If necessary, maintain the desired temperature during the padding procedure by using any suitable heat transfer means such as circulating water through the jacket on the pad box containing the flame retardant finish. When warm rolls of fabric are processed, pass the fabric over cooling means, such as cooling cans, before treating the fabric. The temperature of the finishing bath must be closely controlled or premature polymerization can occur at temperatures above 32° C. Also, inadequate control of the finishing bath temperature may cause non-uniform flame retardancy during long finishing runs.

The textile fabrics should be padded by suitable means such that the wet pick-up is from about 50 percent to about 130 percent and preferably from about 60 percent to about 90 percent of the weight of the untreated fabric. One suitable set of padding conditions includes padding the fabric at from about 6 to 10 tons of pressure using a 1 dip/1 nip or a 2 dip/2 nip fabric lacing and an immersion time of from about 10 to about 12 seconds followed by subjecting the treated fabric to squeezing means to obtain the desired wet pick-up on the treated fabric.

The treated textile fabrics should be dried, preferably frame dried, slightly over the finished width, at from about 104° to about 127° C. and preferably from about 104° to about 110° C.

Curing of the dried fabrics can be done at from about 150° to about 205° C. for from about 90 seconds to about 480 seconds; preferably the curing will be done at about 160° C. for about 300 seconds or at 205° C. for about 120 seconds.

Although fabric drying and curing can take place simultaneously, it is preferred that separate drying and curing operations be performed.

The phosphorus in the treated fabric is oxidized to the +5 valence state by padding the fabric with a solution containing an effective amount of about 5 percent of an oxidizing agent at a temperature of from about 76° to about 83° C. The oxidization treatment and skying time should be such as to insure complete oxidation of the phosphorus in the finish, e.g., from about 30 to about 60 seconds. Both acidic and basic oxidizing agents or conditions may be used. Preferred oxidizing agents include hydrogen peroxide and sodium perborate.

After treatment with the hydrogen perioxide solution, the fabric is then hot rinsed in water at a temperature of from about 71° to about 83° C. neutralized with a dilute 37° C. solution of from about 0.1 percent to about 1.0 percent and preferably about 0.5 percent soda ash; rinsed at about 83° C. and again at 37° C. and dried at about 93° to about 122° C. Optionally, about 0.25 percent of a wetting agent, such as those described above, may be present in the hydrogen peroxide solution.

Many textile fabrics may be treated with the flame retardant finish of this invention. Examples of such textile fabrics include cellulosics, rayon, acrylics, polyesters, acetates, nylon, and textile fabrics derived from animal fibers, such as wool and mohair, and blends thereof. Typical blends would include 35/65, 50/50 and 65/35 blends of polyester/cotton, 50/50 blend of polyester/rayon, and 50/50 blend of acrylic/cotton. Since prior art methods of and means for flame retarding polyester/cotton blend fabrics have proven ineffective, this invention is especially useful for such blends.

The flame retardant finish of this invention, unlike latex base flame retardant systems, does not require the use of a release agent during the fabric processing procedure.

The following examples are provided for the purpose of further illustration only and are not intended to be limitations on the disclosed invention. Unless otherwise specified, all temperatures are in degrees centigrade; all weights are expressed in grams; and all volumes are expressed in milliliters.

EXAMPLE 1

Samples of a 50/50 spun blended polyester and cotton poplin (Style #9503 Testfabric Inc., Middlesex, New Jersey) were treated with finishing formulation A, infra, by a pad, dry, cure and oxidative afterwash procedure.

Formula *A*

52.0% Tetrakis(hydroxymethyl)phosphonium oxalate, 65% aqueous solution
7.4% Water
0.2% Wetting Agent[1]
12.4% Urea
28.0% Emulsion Concentrate consisting of:
- 71.4% Tris(2,3-dibromopropyl)phosphate
- 14.3% Emulsifying Agent[2]
- 14.3% Solvent[3]

[1]The wetting agent was nonionic nonylphenyl polyethylene glycol ether having an HLB value of 13.6. (Tergitol NPX brand wetting agent, Union Carbide Corp., New York, New York)
[2]The emulsifying agent was an anionic blend of oil-soluble metal sulfonates with polyoxyethylene ethers having an HLB value of 12.5. (Emcol N-141 brand emulsifying agent, Witco Chemical Co., Inc., Chicago, Illinois)
[3]The solvent had a flash point of about 110° F. and a boiling point of about 315° F. (Hi-Sol 10 brand solvent, Ashland Chemical Company, Columbus, Ohio)

The wet pick-up of the finish was 69%. The fabrics were dried for five minutes at 105° C. and then cured for two minutes at 205° C. The cured fabrics were oxidized using hydrogen peroxide to insure conversion of all the phosphorus to the +5 valence state. The oxidation was completed in a Kenmore Model 600 washing machine using the following conditions:

(1) Soft water at 60° C., set at a pH of 10 to 11 with sodium carbonate.
(2) 5% hydrogen peroxide (100%) based on the weight of fabrics (owf).
(3) Add treated fabrics and run regular wash cycle, high water level, rinses at 40° to 44° C.

After oxidation the fabrics were tumble-dried in a Kenmore Model 610 electric dryer.

EXAMPLE 2

The same fabric used in Example 1 was treated according to the processing procedure as described in Example 1 using the finishing formulation B, infra.

Formula B 52.0% Tetrakis(hydroxymethyl)phosphonium oxalate, 65% aqueous solution
7.4% Water
0.2% Wetting agent[1]
12.4% Urea
28.0% Emulsion Concentrate consisting of:
- 50.0% Tris(2,3-dibromopropyl)phosphate
- 10.0% Emulsifying Agent[2]
- 40.0% Solvent[3]

The wet pick-up of finish was 69%.
[1]The wetting agent was a nonionic octylphenoxy polyethoxy ethanol having an HLB value of 13.5. (Triton X-100 brand wetting agent, Rohn & Haas Co., Philadelphia, Pennsylvania)
[2]The emulsifying agent was the same as that employed in Example 1.
[3]The solvent was the same as that employed in Example 1.

EXAMPLE 3

The same fabric used in Example 1 was treated according to the processing procedure as described in Example 1 using the finishing formulation C, infra.

Formula C 52.0% Tetrakis(hydroxymethyl)phosphonium oxalate, 65% aqueous solution
35.4% Water
0.2% Wetting agent[1]
12.4% Urea

[1]The wetting agent was the same as that employed in Example 2.

EXAMPLE 4

The flame retardancy of the treated fabrics of Examples 1, 2, and 3 was evaluated using the procedures established by the "Standard for the Flammability of Children's Sleepwear", U.S. Department of Commerce FF 3-71 (DOC FF 3-71). The durability of the flame retardant treatment was determined by measuring the char lengths of the treated fabrics after multiple laundering and drying by cycles as set forth in DOC FF 3-71, incorporated herein in toto by reference.

Char length data for the untreated fabric and the treated fabrics of Examples 1, 2, and 3 are shown in the following Table I.

TABLE I

| | Char Length, Inches (DOC FF 3-71) | | | | | |
|---|---|---|---|---|---|---|
| | Laundering and Drying Cycles | | | | | |
| Fabric | 0 | 10 | 20 | 30 | 40 | 50 |
| Untreated | BEL[1] | | | | | |
| Example #1 | 2.4 | 2.9 | 2.9 | 3.6 | 2.5 | 6.1 |
| Example #2 | 2.6 | 4.2 | BEL | BEL | BEL | BEL |
| Example #3 | BEL | | | | | |

[1]BEL — Specimen burned the entire length.

EXAMPLE 5

Four polyester and cotton blended fabrics prepared and dyed by several dyeing and finishing plants were treated with Formula A and the processing procedures of Example 1. Information on fabric construction, fiber blend levels and char length data for the treated fabrics is given in Table II. All of the untreated fabrics fail the char length test DOC FF 3-71 prior to any laundering.

TABLE II

| Fabric | Blend Level PET[1]/Cotton | Char Length, Inches DOC FF 3-71 Laundering and Drying Cycles 0 | 10 | 50 |
|---|---|---|---|---|
| Denim[2] | 50/50 | 0.5 | — | 2.6 |
| Crepe | 50/50 | 1.0 | 1.7 | 4.8 |
| Denim[3] | 50/50 | 0.5 | — | 1.5 |
| Flannel | 35/65 | 1.2 | — | 2.3 |

[1]PET means polyester
[2]Undesized
[3]Desized

As Table II, supra, indicates all of the polyester and cotton blended fabrics treated with Formula A passed the DOC FF 3-71 flammability test. It should also be noted that the hand of each of the above treated fabrics was commercially acceptable. This excellent retention of hand is even more impressive when one realizes that although the prior art points out that "(f)abrics should be completely desized before processing since the presence of size imparts excessive stiffness", W.A. Reeves, G.L. Drake, Jr. and R.M. Perkins, "Fire Resistant Textiles Handbook," 87, Technomic Publishing Conmpany, Westport, Connecticut, 1974, the desized as well as the undesized fabrics treated with the Formula A finish possessed commercially acceptable hand.

EXAMPLE 6

Samples of the same fabric used in Example 1 were treated with the finishing formulation D, infra, by a pad, dry cure and oxidative afterwash procedure. The wet pick-up of the finish was 76%. The treated fabrics were then dried, cured, oxidative afterwashed and tumbled dried in the manner set forth in Example 1.

Formula D 52.0% Tetrakis(hydroxymethyl)phosphonium phosphate acetate, 65% aqueous solution
7.2% Water
0.4% Wetting agent[1]
12.4% Urea
28.0% Emulsion Concentrate[2]

[1]The wetting agent was a nonionic polyalkylene glycol ether. (Tergitol TMN-6 brand wetting agent, Union Carbide Corp., New York, New York)
[2]The emulsion concentrate was the same as that employed in Example 1.

EXAMPLE 7

The same fabric used in Example 6 was treated according to the processing procedure as described in Example 6 using the finishing formulation E, infra.

Formula E 52.0% Tetrakis(hydroxymethyl)phosphonium phosphate acetate, 65% aqueous solution
35.2% Water
0.4% Wetting agent[1]
12.4% Urea

[1]The wetting agent used was the same as that employed in Example 6.

EXAMPLE 8

The flame retardancy of the treated fabrics of Examples 6 and 7 was evaluated by the procedure set forth in Example 5, supra.

Char length data for the untreated fabric and the treated fabrics of Examples 6 and 7 after multiple laundering cycles is shown in Table III.

TABLE III

| Fabric | Char Length, Inches (DOC FF 3-71) Laundering and Drying Cycles 10 | 20 | 30 | 40 | 50 |
|---|---|---|---|---|---|
| Untreated | BEL | | | | |
| Example #6 | 2.9 | 2.8 | 3.3 | 2.9 | 4.0 |
| Example #7 | BEL | | | | |

EXAMPLE 9

Samples of the same fabric used in Example 1 were treated with the finishing formulation E, infra, by a pad, dry, cure and oxidative afterwash procedure.

Formula E 496 gms Urea
296 gms Water
40 gms Wetting agent[1]
1120 gms Emulsion concentrate[2]
2080 gms Tetrakis(hydroxymethyl)phosphonium phosphate acetate, 65% aqueous solution

[1]The wetting agent was an anionic phosphate surfactant in free acid form. (Triton QS-44 brand wetting agent, Rohn and Haas Co., Philadelphia, Pennsylvania)
[2]The emulsion concentrate was the same as that employed in Example 1.

The treated fabric samples were dried 5 minutes at 105° C. and cured 5 minutes at 160° C. The samples were oxidized as follows:

(1) Pad, 3 times with a solution of 5% hydrogen peroxide (100%) at 80° C.
(2) Rinse in water at 60° C. to remove excess peroxide using a Kenmore Model 600 washing machine set on regular wash cycle, high water level and rinse water at 40° C.
(3) Repeat above cycle using a 0.05% solution of sodium carbonate at 60° C. in wash cycle to neutralize any residual acidity, complete rinses at 40° C. and tumble dry.

The durability of the flame retardant finish Formula E, supra, on the treated fabrics of this example was evaluated by measuring the char lengths (DOC FF 3-71) of the treated fabrics after multiple dry cleanings. A Norge-coin operated machine was used with a dry cleaning detergent in the perchloroethylene solvent, i.e., in a charged system.

Char length data for the untreated fabric and treated fabric of Example 8 are shown in Table IV.

TABLE IV

| Fabric | Char Length, Inches (DOC FF 3-71) Dry Cleaning Cycles 10 | 20 | 30 | 40 | 50 |
|---|---|---|---|---|---|
| Untreated | BEL | | | | |
| Example #8 | 3.0 | 2.7 | 4.7 | 3.0 | 4.7 |

EXAMPLE 10

Samples of an undesized 65/35 polyester and cotton denim were treated with finishing formulation E of Example 9 by a pad, dry, cure and oxidative afterwash procedure.

The treated fabric samples were dried 5 minutes at 105° C. and cured 5 minutes at 150° C. The samples were oxidized as follows:

(1) Pad, 3 times with a solution of 5% hydrogen peroxide (100%) at 80° C.
(2) Rinse fabric by padding 5 times through water at 80° C. The water is changed after each padding operation.

(3) Neutralize fabric by padding twice through a solution of 0.5% sodium carbonate at 80° C.

(4) Rinse fabric by padding twice through water at 80° C. The water is changed after each padding operation and the samples were dried on pin frames at 106° C.

The flame retardancy of the treated fabric of this example was evaluated by the procedure set forth in Example 4, supra.

Char length data for the untreated fabric of this example are shown in Table V.

TABLE V

| Char Length, Inches DOC FF 3-71 | | |
|---|---|---|
| | Laundering Cycles | |
| Fabric | O | 50 |
| Untreated | BEL | BEL |
| Example #9 | N.D.[1] | 2.8 |

[1]Not Determined.

EXAMPLE 11

An emulsion concentrate (1800 gms) within the scope of U.S. Pat. No. 3,729,434 and comprising 50 percent tris(2,3-dibromopropyl)phosphate, 10.0 percent emulsifying agent, and 40.0 percent solvent, said emulsifying agent and solvent being the same as that employed in Example 2, was diluted to a 60 percent solution (hereinafter referred to as "Solution X") with 1200 gms of water. The concentration of active flame retardant in Solution X is 30.0 percent.

Similarly, an emulsion concentrate (1428 gms) within the scope of this invention and comprising 71.4 percent tris(2,3-dibromopropyl)phosphate, 14.3 percent emulsifying agent, and 14.3 percent solvent, said emulsifying agent and solvent being the same as that employed in the above emulsion concentrate, was diluted to a 71.4 percent solution (hereinafter referred to as "Solution Y") with 572 gms of water. The concentration of active flame retardant in Solution Y is 51 percent.

The viscosity of both Solution X and Solution Y was determined by the use of a Brookfield viscosimeter (Model LVF) and found for both solutions to be approximately 560± 10 centipoise at room temperature (a temperature within the range of use of both solutions).

This unexpected phenomenon of two solutions containing different amounts of solids but possessing the same viscosity enables Solution Y to deliver more solids at the same viscosity as exhibited by Solution X and therefore enables Solution Y to possess better flame retarding efficacy than possessed by Solution X.

The above specification as well as the examples contained therein clearly establish that the novel flame retardant finishes of this invention are capable of rendering textile materials, including polyester/cotton blend fabrics, treated therewith flame retardant, i.e., capable of passing the DOC FF 3-71 flammability test, while not significantly detrimentally affecting the hand of the treated fabrics and textiles. In view of the infantile state of the prior art, see G. C. Tesoro, supra, the novel characteristics of polyester/cotton blend fabrics, see Textile Research Institute's press release, supra, the misdirections of the prior art, see V. Mischutin and Dr. W. F. Battinger, supra, and the need for an effective commercial flame retardant capable of meeting the requirements of DOC FF 3-71, see R. B. LeBlanc and D. A. LeBlanc, supra, the present invention must truly be considered a giant step forward in the art of rendering textiles and fabrics flame retardant.

Based on this disclosure, many other modifications and ramifications will naturally suggest themselves to those skilled in the art. These are intended to be comprehended as within the scope of this invention.

The embodiments of the invention in which an exclusive property or privilege is claimed are defined as follows:

1. A flame retardant textile finish, said textile being cotton or a blend of cotton and polyester fibers, consisting essentially of:

(a) from about 16 percent to about 30 percent of a flame retardant compound of the formula

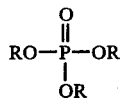

wherein each R is independently selected from halogenated aliphatic groups containing from 2 to about 6 carbon atoms and from 1 to about 3 halogen substituents per group;

(b) from about 3.2 percent to about 4.8 percent of a substantially water immiscible organic solvent characterized by having a flash point of at least 80° F. and a boiling point within the range of from about 300° to about 350° F.;

(c) from about 3.2 percent to about 4.8 percent of an emulsifying agent possessing a hydophile lipophile balance value of from about 10 to about 14;

(d) from about 27 percent to about 41 percent of a water soluble quaternary phosphonium salt selected from the group consisting of tetrakis(hydroxymethyl)phosphonium and tetrakis(methylhydroxymethyl) phosphium salts;

(e) from about 10 percent to about 15 percent of a water soluble organic nitrogen containing compound selected from the group consisting of urea, thiourea, guanidine and dicyandiamide (f) from about 20 percent to about 31 percent of water.

2. The flame retardant finish of claim 1 comprising:

(a) from about 18 percent to about 22 percent of said flame retardant compound selected from $(XH_2C—XHC—H_2C—O)_3—P{=}O$ and $(XH_2C—HC(CH_2X)—O)_3—P{=}O$ where X is chlorine or bromine;

(b) from about 3.6 percent to about 4.4 percent of said solvent;

(c) from about 3.6 percent to about 4.4 percent of said emulsifying agent comprising an oil soluble metal sulfonate and a polyoxyethylene ether blended in proportions such that the emulsifying agent possesses a value of about 10 to about 14 with respect to its hydrophile lipophile balance;

(d) from about 30.4 percent to about 37.2 percent of said water soluble quaternary phosphonium salt, said quaternary phosphonium salt being a tetrakis(hydroxymethyl)phosphonium salt selected from the group comprising tetrakis(hydroxymethyl)phosphonium oxalate, tetrakis(hydroxymethyl)phosphonium phosphate acetate, tetrakis(hydroxymethyl)phosphonium chloride, and bis(tetrakis(hydroxymethyl)phosphonium)sulfate;

(e) from about 11.2 percent to about 13.6 percent of said water soluble organic nitrogen containing compounds; and (f) from about 23.2 percent to about 28.4 percent of said water.

3. The flame retardant finish of claim 2 wherein said flame retardant compound is $(XH_2C—XHC—H_2C—O)_3—P=O$.

4. The flame retardant finish of claim 3 wherein said flame retardant is tris(2,3-dibromopropyl)phosphate.

5. The flame retardant finish of claim 2 wherein said water soluble organic nitrogen containing compound is urea.

6. The flame retardant finish of claim 2 wherein said tetrakis(hydroxymethyl)phosphonium salt is selected from the group comprising tetrakis(hydroxymethyl)-phosphonium oxalate and tetrakis(hydroxymethyl)-phosphonium phosphate acetate.

7. The flame retardant finish of claim 2 wherein said flame retardant compound is $(XH_2C—XHC—H_2C—O)_3—P=O$; and said tetrakis(hydroxymethyl)phosphonium salt selected from the group comprising tetrakis(hydroxymethyl)phosphonium oxalate and tetrakis(hydroxymethyl)phosphonium phosphate acetate.

8. The flame retardant finish of claim 7 wherein said flame retardant compound is tris(2,3-dibromopropyl)-phosphate, wherein said water soluble organic nitrogen containing compound is urea, and wherein said tetrakis(hydroxymethyl)phosphonium salt is tetrakis(hydroxymethyl)phosphonium phosphate acetate.

9. The flame retardant finish of claim 2 which also contains from about 0.2 percent to about 0.8 percent of wetting agent.

10. The flame retardant finish of claim 2 comprising:

(a) about 20 percent of said flame retardant compound;

(b) about 4 percent of said solvent;

(c) about 4 percent of said emulsifying agent;

(d) about 33.8 percent of said tetrakis(hydroxymethyl)phosphonium salt;

(e) about 12.4 percent of said water soluble organic nitrogen containing compound; and (f) about 25.8 percent of said water.

11. The flame retardant finish of claim 10 wherein said flame retardant compound is $(XH_2C—XHC—H_2C—O)_3—P=O$.

12. The flame retardant finish of claim 11 wherein said flame retardant compound is tris(2,3-dibromopropyl)phosphate.

13. The flame retardant finish of claim 10 wherein said water soluble ogranic nitrogen containing compound is urea.

14. The flame retardant finish of claim 10 wherein said tetrakis(hydroxymethyl)phosphonium salt is selected from the group comprising tetrakis(hydroxymethyl)phosphonium oxalate and tetrakis(hydroxymethyl)phosphonium phosphate acetate.

15. The flame retardant finish of claim 10 wherein said flame retardant compound is $(XH_2C—XHC—H_2C—O)_3—P=O$; and said tetrakis(hydroxymethyl)phosphonium salt is selected from the group comprising tetrakis(hydroxymethyl)phosphonium oxalate and tetrakis(hydroxymethyl)phosphonium phosphate acetate.

16. The flame retardant finish of claim 15 wherein said flame retardant compound is tris(2,3-dibromopropyl)phosphate, and wherein said water soluble organic nitrogen containing compound is urea.

17. The flame retardant finish of claim 16 wherein said tetrakis(hydroxymethyl)phosphonium salt is tetrakis(hydroxymethyl)phosphonium oxalate.

18. The flame retardant finish of claim 16 wherein said tetrakis(hydroxymethyl)phosphonium salt is tetrakis(hydroxymethyl)phosphonium phosphate acetate.

19. The flame retardant finish of claim 10 which also contains about 0.6 percent of wetting agent.

20. The flame retardant finish of claim 1 wherein said flame retardant compound is selected from $(XH_2C—XHC—H_2C—O)_3—P=O$ and $(XH_2—HC(CH_2X)—O)_3—P=O$ wherein X is chlorine or bromine; wherein said emulsifying agent comprises an oil soluble metal sulfonate and a polyoxyethylene ether blended in proportions such that the emulsifying agent possesses a value of about 10 to about 14 with respect to its hydrophile lipophile balance; and wherein said water soluble quaternary phosphonium salt is a tetrakis(hydroxymethyl)phosphonium salt selected from the group comprising tetrakis(hydroxymethyl)-phosphonium oxalate, tetrakis(hydroxymethyl)phosphonium phosphate acetate, tetrakis(hydroxymethyl)-phosphonium phosphate chloride, and bis(tetrakis(hydroxymethyl)phosphonium) sulfate.

21. The flame retardant finish of claim 20 wherein said flame retardant compound is $(XH_2C—XHC—H_2C—O)_3—P=O$.

22. The flame retardant finish of claim 21 wherein said flame retardant compound is tris(2,3-dibromopropyl)phosphate.

23. The flame retardant finish of claim 20 wherein said water soluble ogranic nitrogen containing compound is urea.

24. The flame retardant finish of claim 20 wherein said tetrakis(hydroxymethyl)phosphonium salt is selected from the group comprising tetrakis(hydroxymethyl)phosphonium oxalate and tetrakis(hydrosymethyl)phosphonium phosphate acetate.

25. The flame retardant finish of claim 20 wherein said flame retardant comprises $(XH_2C—XHC—H_2C—0)_3—P=0$; and said tetrakis(hydroxymethyl)phosphonium salt is selected from the group comprising tetrakis(hydroxymethyl)phosphonium oxalate and tetrakis(hydroxymethyl)phosphonium phosphate acetate.

26. The flame retardant finish of claim 26 wherein said flame retardant compound is tris(2,3-dibromopropyl)phosphate, wherein said water soluble organic nitrogen containing compound is urea, and wherein said tetrakis(hydroxymethyl)phosphonium salt is tetrakis(-hydroxymethyl)phosphonium phosphate acetate.

27. The flame retardant finish according to claim 20 which also contains from about 0.1 percent to about 1.0 percent of a wetting agent.

28. The flame retardant finish according to claim 1 which also contains from about 0.1 percent to about 1.0 percent of a wetting agent.

29. A process for treating textile materials to render them flame retardant which comprises applying to said textile the flame retardant finish of claim 1.

30. A textile material obtained by the process of claim 29.

31. An emulsion concentrate for preparing the textile finish of claim 1 comprising:

(a) from about 66.0 percent to about 78.5 percent of a flame retardant compound of the formula

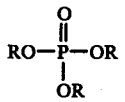

wherein each R is independently selected from halogenated aliphatic groups conaining from 2 to about 6 carbon atoms and from 1 to about 3 halogen substituents per group;

(b) from about 13.2 percent to about 15.7 percent of a substantially water immiscible organic solvent characterized by having a flash point of at least 80° F. and a boiling point within the range of from about 300° to about 350° F.; and (c) from about 13.2 percent to about 15.7 percent of an emulsifying agent possessing a hydrophile lipophile balance value of from 10 to about 14.

32. The emulsion concentrate of claim 31 comprising:

(a) from about 68.5 percent to about 75.7 percent of said flame retardant compound;

(b) from about 13.7 percent to about 15.2 percent of said solvent; and (c) from about 13.7 percent to about 15.2 percent of said emulsifying agent.

33. The emulsion concentrate of claim 32 comprising:

(a) about 71.4 percent of said flame retardant compound;

(b) about 14.3 percent of said solvent; and (c) about 14.3 percent of said emulsifying agent.

34. The emulsion concentrate of claim 31 wherein said flame retardant is selected from $(XH_2C—XHC—H_2C—O)_3—P=O$ and $(XH_2C—HC(CH_2X)—O)_3—P=O$ wherein X is chlorine or bromine and wherein said emulsifying agent comprises an oil soluble metal sulfonate and a polyoxyethylene ether blended in proportions such that the emulsifying agent possesses a value of about 10 to about 14 with respect to its hydrophile lipophile balance.

35. The emulsion concentrate of claim 34 wherein said flame retardant compound is $(XH_2C—XHC—H_2C—O)_3—P=O$.

36. The emulsion concentrate of claim 35 wherein said flame retardant compound is tris(2,3-dibromopropyl)phosphate.

37. An emulsion for preparing the textile finish of claim 1 comprising:

(a) from about 45.0 percent to about 55.0 percent of a flame retardant compound of the formula

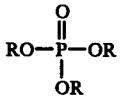

wherein each R is independently selected from halogenated aliphatic groups containing from 2 to about 6 carbon atoms and from 1 to about 3 halogen substituents per group;

(b) from about 9.0 percent to about 11.0 percent of a substantially water immiscible organic solvent characterized by having a flash point of at least 80° F. and a boiling point within the range of from about 300° to about 350° F.;

(c) from about 9.0 percent to about 11.0 percent of an emulsifying agent possessing a hydrophile lipophile balance of from about 10 to about 14; and (d) from about 27.0 percent to about 33.0 percent of water.

38. The emulsion of claim 37 comprising:

(a) from about 47.5 percent to about 52.5 percent of said flame retardant compound;

(b) from about 9.5 percent to about 10.5 percent of said solvent;

(c) from about 9.5 percent to about 10.5 percent of said emulsifying agent; and (d) from about 28.5 percent to about 31.5 percent of said water.

39. The emulsion of claim 38 comprising:

(a) about 50 percent of said flame retardant compound;

(b) about 10 percent of said solvent;

(c) about 10 percent of said emulsifying agent; and (d) about 30 percent of said water.

40. The emulsion of claim 37 wherein said flame retardant compound is selected from $(XH_2C—XHC—H_2C—O)_3—P=O$ and $(XH_2C—HC(CH_{2-X})—O)_3—P=O$ wherein X is chlorine or bomine and wherein said emulsifying agent comprises an oil soluble metal sulfonate and a polyoxyethylene ether blended in proportions such that the emulsifying agent possesses a value of about 10 to about 14 with respect to its hydrophile lipophile balance.

41. The emulsion of claim 40 wherein said flame retardant compound is $(XH_2C—XHC—H_2C—O)_3—P=O$.

42. The emulsion of claim 41 wherein said flame retardant compound is tris(2,3-dibromopropyl)phosphate.

43. An intermediate flame retardant composition comprising:

(a) from about 19.6 percent to about 26.6 percent of a flame retardant compound of the formula

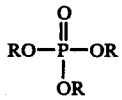

wherein each R is independently selected from halogenated aliphatic groups containing from 2 to about 6 carbon atoms and from 1 to about 3 halogen substituents per group;

(b) from about 3.9 percent to about 5.1 percent of a substantially water immiscible organic solvent characterized by having a flash point of at least 80° F. and a boiling point within the range of from about 300° to about 350° F.

(c) from about 3.9 percent to about 5.1 percent of an emulsifying agent possessing a hydrophile lipophile balance value of from about 10 to about 14;

(d) from about 32.7 percent to about 44.3 percent of a water soluble quaternary phosphonium salt, selected from the group consisting of tetrakis(hydroxymethyl)phosphonium and tetrakis(methylhydroxymethyl)phosphonium salts; and (e) from about 25.0 percent to about 33.8 percent of water.

44. The intermediate flame retardant composition of claim 43 comprising:

(a) from about 20.8 percent to about 25.4 percent of said flame retardant compound;

(b) from about 4.0 percent to about 5.0 percent of said solvent;

(c) from about 4.0 percent to about 5.0 percent of said emulsifying agent;

(d) from about 34.6 percent to 42.4 percent of said water soluble quaternary phosphonium salt; and
(e) from about 26.5 percent to about 32.3 percent of said water.

45. The intermediate flame retardant finish of claim 44 comprising:
(a) about 23.1 percent of said flame retardant compound;
(b) about 4.5 percent of said solvent;
(c) about 4.5 percent of said emulsifying agent;
(d) about 38.5 percent of said tetrakis(hydroxymethyl)phosphonium salt; and
(e) about 29.4 percent of said water.

46. The intermediate flame retardant composition of claim 47 wherein said flame retardant compound is selected from $(XH_2C—XHC—H_2C—O)_3—P=O$ and $(XH_2C—HC(CH_2X—O)_3—P=O$ wherein X is chlorine or bromine; wherein said emulsifying agent comprises an oil soluble metal sulfonate and a polyoxyethylene ether blended in proportions such that the emulsifying agent possesses a value of about 10 to about 14 with respect to its hydrophile lipophile balance; and wherein said water soluble quaternary phosphonium salt is a tetrakis(hydroxymethyl)phosphonium salt selected from the group comprising tetrakis(hydroxymethyl)phosphonium oxalate, tetrakis(hydroxymethyl)phosphonium acetate, tetrakis(hydroxymethyl)phosphonium chloride, and bis(tetrakis(hydroxymethyl)phosphonium) sulfate.

47. The intermediate flame retardant composition of claim 46 wherein said flame retardant compound is $(XH_2C—XHC—H_2C—O)_3—P=O$.

48. The intermediate flame retardant composition of claim 47 wherein said flame retardant compound is tris(2,3-dibromopropyl)phosphate.

49. The intermediate flame retardant composition of claim 48 wherein said tetrakis(hydroxymethyl)phosphonium salt is selected from the group comprising tetrakis(hydroxymethyl)phosphonium oxalate and tetrakis(hydroxymethyl)phosphonium phosphate acetate.

50. The flame retardant finish of claim 51 which also contains about 0.2 to about 0.8 percent of wetting agent.

* * * * *